US006572798B2

(12) United States Patent
Nitschke et al.

(10) Patent No.: US 6,572,798 B2
(45) Date of Patent: Jun. 3, 2003

(54) APPARATUS AND METHOD FOR SPINNING A MULTIFILAMENT YARN

(75) Inventors: Roland Nitschke, Hagen (DE); Hansjörg Meise, Cologne (DE); Hans-Gerhard Hutter, Remscheid (DE); Ulrich Enders, Remscheid (DE); Peter Senge, Dortmund (DE); Detlev Schulz, Radevormwald (DE); Dieter Wiemer, Wermelskirchen (DE)

(73) Assignee: Barmag AG, Remscheid (DE)

( * ) Notice: Subject to any disclaimer, the term of this patent is extended or adjusted under 35 U.S.C. 154(b) by 216 days.

(21) Appl. No.: 09/747,615

(22) Filed: Dec. 22, 2000

(65) Prior Publication Data

US 2001/0033037 A1 Oct. 25, 2001

Related U.S. Application Data

(63) Continuation of application No. PCT/EP99/04225, filed on Jun. 17, 1999.

(30) Foreign Application Priority Data

Jun. 22, 1998 (DE) ..... 198 27 518
Jun. 29, 1998 (DE) ..... 198 29 046

(51) Int. Cl.[7] ..... D01D 5/092; D01D 7/00; D01D 13/00; D02G 3/02

(52) U.S. Cl. ..... 264/40.3; 264/101; 264/103; 264/211.12; 264/211.14; 264/237; 425/72.2; 425/135; 425/143; 425/377; 425/378.2; 425/379.1; 425/382.2; 425/464

(58) Field of Search ..... 264/40.1, 40.3, 264/101, 103, 211.12, 211.14, 237; 425/72.2, 135, 143, 377, 378.2, 379.1, 382.2, 464

(56) References Cited

U.S. PATENT DOCUMENTS

| | | | |
|---|---|---|---|
| 4,529,368 | A | 7/1985 | Makansi |
| 4,687,610 | A | 8/1987 | Vassilatos |
| 4,712,988 | A | 12/1987 | Broaddus et al. |
| 4,743,186 | A | 5/1988 | Schippers |
| 5,034,182 | A | 7/1991 | Sze et al. |
| 5,219,852 | A | 6/1993 | Anderson et al. |
| 5,593,705 | A | 1/1997 | Schilo et al. |
| 5,700,490 | A | 12/1997 | Meise |
| 5,976,431 | A | 11/1999 | Mears |

FOREIGN PATENT DOCUMENTS

| | | | |
|---|---|---|---|
| CH | 678 433 | A5 | 9/1991 |
| DE | 25 39 840 | A1 | 5/1976 |
| DE | 195 35 143 | A1 | 4/1996 |
| EP | 0 613 966 | A1 | 9/1994 |
| EP | 0 580 977 | B1 | 9/1997 |
| WO | WO 95/15409 | A1 | 6/1995 |

*Primary Examiner*—Leo B. Tentoni
(74) *Attorney, Agent, or Firm*—Alston & Bird LLP

(57) ABSTRACT

An apparatus and method for spinning a synthetic yarn, wherein a heated polymeric melt is extruded through a spinneret and the resulting filaments are combined and wound to a package by means of a take-up device located downstream of the spinneret. A cooling tube for the filaments is positioned below the spinneret, and an inlet cylinder which has a gas permeable wall is positioned between the inlet cylinder and the cooling tube. The cooling tube connects to an air stream generator in such a manner that an air stream develops in the cooling tube in the direction of the advancing yarn. The air stream is formed by a quantity of air that enters the cooling tube via the inlet cylinder, and the inlet cylinder is subdivided in the direction of the advancing yarn into several zones, each with a different gas permeability, for controlling the quantity of air entering the inlet cylinder. It is thereby possible to influence with advantage the precooling of the yarn and the formation of the air stream.

30 Claims, 6 Drawing Sheets

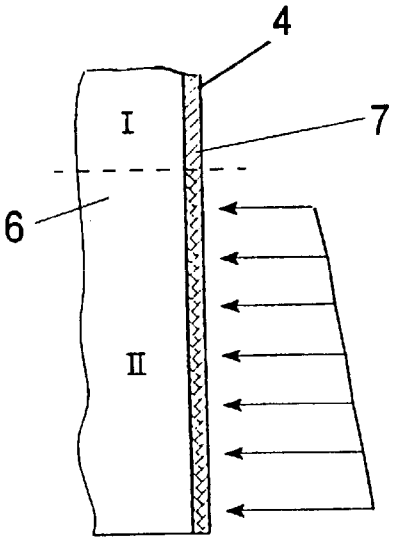
Fig.3.3
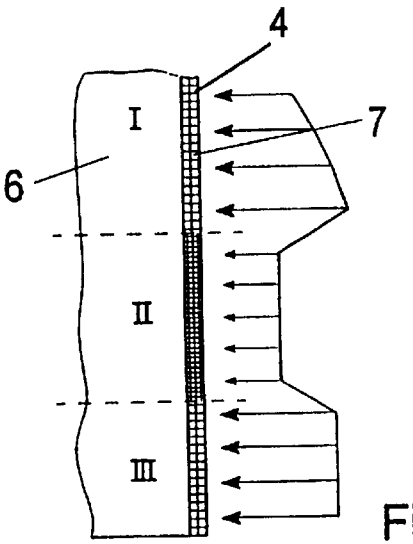
Fig.3.2
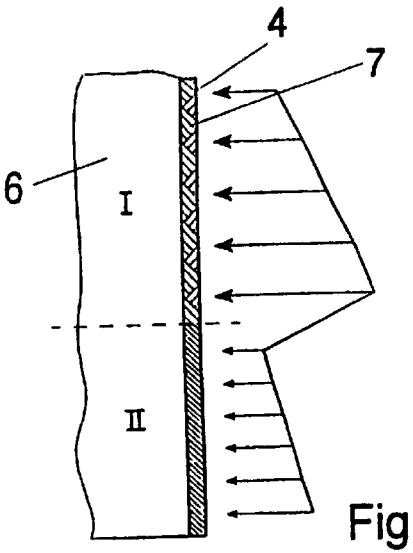
Fig.3.1

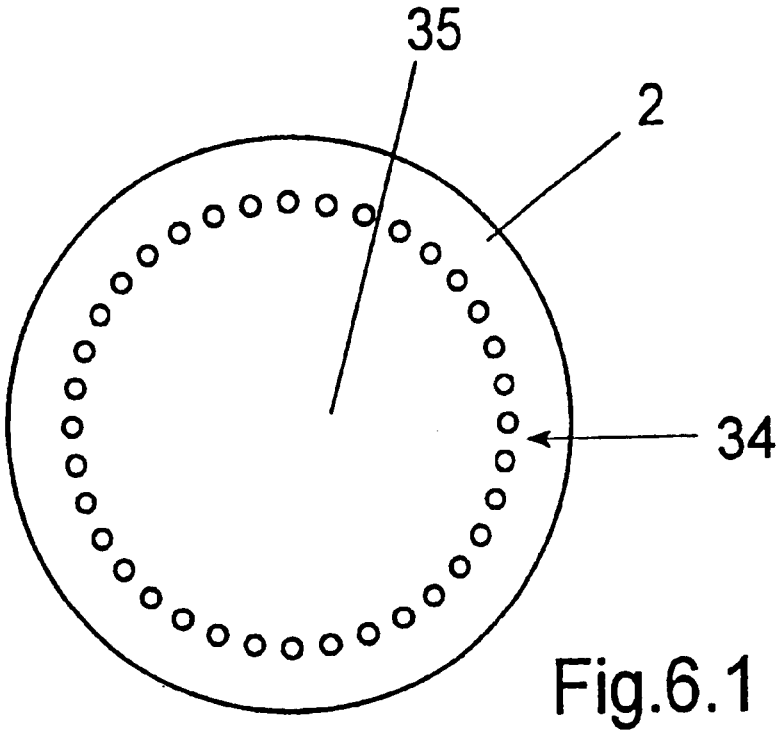
Fig.6.1
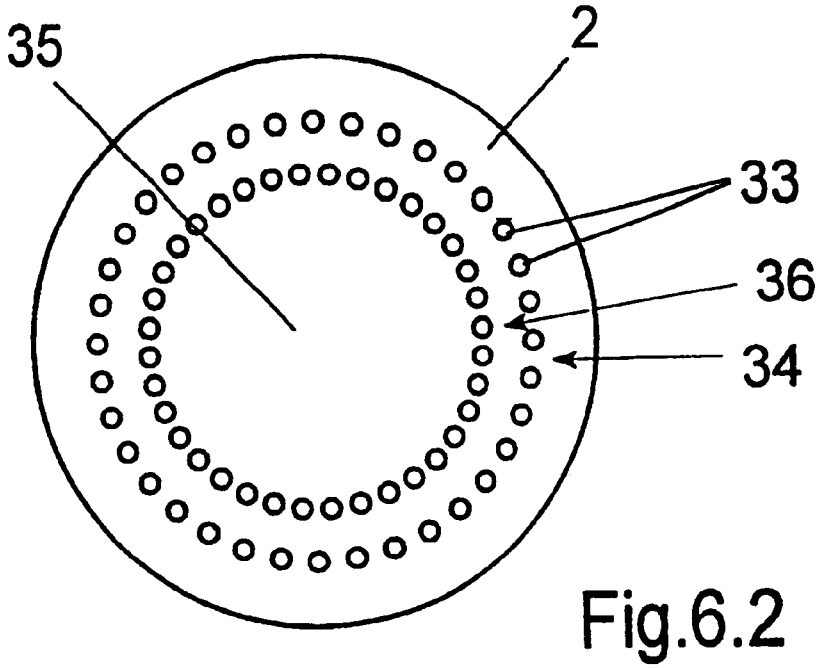
Fig.6.2

APPARATUS AND METHOD FOR SPINNING A MULTIFILAMENT YARN

CROSS REFERENCE TO RELATED APPLICATION

This is a continuation of copending international application PCT/EP99/04225, filed Jun. 17, 1999, and designating the U.S.

BACKGROUND OF THE INVENTION

The present invention relates to an apparatus and method for spinning a synthetic multifilament yarn of the type disclosed in WO 95/15409 and corresponding U.S. Pat. No. 5,976,431.

In the apparatus and process of the above referenced publications, an air stream assists freshly extruded filaments in their advance. With that, it is accomplished that the solidification point of the filaments moves away from the spinneret. This leads to a delayed crystallization that favorably influences the physical properties of the yarn. Thus, for example, in the production of a POY yarn, it was possible to increase the withdrawal speed and thus, the draw ratio, without changing the elongation values of the yarn necessary for further processing.

The known spinning apparatus comprises a cooling tube and an air stream generator downstream of the spinneret. Between the spinneret and the cooling tube, an inlet cylinder extends with a gas-permeable wall. By the interaction of the inlet cylinder and the air stream generator, a quantity of air is caused to enter the cooling shaft, and to advance within the cooling shaft as an accelerated air stream in the direction of the advancing yarn. The inlet cylinder consists of a perforated, gas-permeable material. Therefore, the radially inflowing air quantity is proportional to the applied pressure difference that becomes greater as the yarn speed increases. Thus, the quantity of air entering the inlet cylinder becomes greater with an increasing distance from the spinneret.

However, it has shown that besides assisting the advance, it is necessary that the filaments uniformly firm up in their surface layers. While advancing through the inlet cylinder, the filaments are precooled in such a manner that the surface layer has firmed up before entering the cooling tube. In their core, the filaments are still molten when they enter the cooling tube, so that the final solidification occurs only in the cooling tube. Consequently, it is also necessary that all filaments be uniformly precooled. Furthermore, it is desirable to have a uniform quantity of air present over the entire cross section of the inlet cylinder, so that each filament in the cooling tube is uniformly assisted in its advance.

In the production of a yarn, the quality of the yarn is determined by the interaction of the filament properties. It is therefore known that for producing a high-quality yarn, each filament within a bundle of filaments must undergo an equal treatment. In the known method and apparatus, the solidification point is deliberately removed from the spinneret, so that the filaments solidify only after passing through a precooling zone in the cooling zone formed by the cooling tube. Thus, the filaments cover a relatively long distance, over which they are exposed to different air streams.

U.S. Pat. No. 5,034,182 discloses a spinning apparatus, wherein the inlet cylinder is arranged in a pressure chamber. The inlet cylinder has a screen-like wall, so that based on the overpressure prevailing outside of the inlet cylinder, a greater pressure difference is obtained and, thus, a larger quantity of inflowing air. However, this leads to the problem that the filaments are already exposed to a considerable cooling effect within the inlet zone.

It is therefore an object of the invention to further develop a spinning apparatus of the initially described type such that it is possible to make available an air quantity adjusted to the uniform precooling of the filaments and an air quantity necessary for assisting the movement of the filaments.

Another further object of the invention is to further develop the method and the spinning apparatus such that all filaments of the filament bundle undergo a substantially uniform treatment until their solidification.

SUMMARY OF THE INVENTION

The above and other objects and advantages of the present invention are achieved by the provision of a melt spinning apparatus and method wherein the inlet cylinder is subdivided into several zones in the direction of the advancing yarn, each with a different permeability to gas for controlling the air quantity entering the inlet cylinder.

The invention would not have been suggested either by the spinning apparatus known from EP 0 580 977 or the spinning apparatus disclosed in DE 195 35 143. In the known spinning apparatus, the inlet cylinder downstream of the spinneret is constructed with its air permeability varying in the direction of the advancing yarn, so as to realize a cooling the filaments as a function of the yarn advance speed. The purpose of the known spinning apparatus is a complete cooling of the filaments within the inlet cylinder, and they are thus totally unsuited to generate an air stream that assists in the movement of the filaments in the case of only precooled filaments.

The invention has the advantage that, irrespective of the filament speed and irrespective of the differential pressure between the spin shaft and the surroundings, it is possible to influence the air quantity flowing into the spin shaft. This makes it possible to exert a purposeful influence on the properties of the filaments that originate from different zones of the spinneret. On the one hand, the influence may lie in that all filaments undergo a precooling for firming up the surface zones, if possible under the same cooling conditions. Furthermore, it is possible to influence the entry of the filaments into the cooling tube, as well as the development of the air stream in the cooling tube, in particular by the air quantity entering into the lower region of the inlet cylinder. The air quantity entering through the wall of the inlet cylinder is proportionately dependent on the gas permeability or the porosity of the wall. In the case of a high gas permeability, a larger quantity of air per unit time is introduced into the spin shaft under otherwise constant conditions. Conversely, in the case of a low gas permeability of the wall, a proportionately smaller air quantity enters the spin shaft.

The upper zone may have a greater gas permeability in the wall than the lower zone. This has the advantage that a relatively large quantity of air is available for cooling the filaments. A further advantage lies in that a substantially uniform distribution of the air quantity adjusts itself inside the spin shaft. Since in the upper zone the filament speed is low, and since furthermore the filaments are spaced from each other relatively wide due to the small distance from the spinneret, the air quantity is able to distribute itself in the upper zone of the inlet cylinder substantially unimpeded over the entire cross section of the spin shaft. With that, it is accomplished that within the filament bundle, a uniform air stream is able to develop in the cooling tube.

Alternatively, the upper zone may have a smaller gas permeability than the lower zone. This is especially suited to treat the filaments in a relatively weak precooling. From this follows the advantage of a particularly gentle cooling, which means a further improvement in spinning reliability. Spinning reliability means in this instance the quantity of filament breaks.

In the lower zone facing the cooling tube, however, a relatively large quantity of air enters the spin shaft, which facilitates the entry of the filament bundle into the cooling tube. This advantageously prevents the filaments from striking the tube wall in the region of the narrowest cross section.

It is also possible to decrease the gas permeability in the upper zone such that the upper zone becomes impermeable to gas. Thus, a quiet zone develops directly downstream of the spinneret. This quiet zone ensures a stable spinning of the filaments, and thus favors the formation of a uniform filament structure.

An intermediate zone may be positioned between the upper and lower zones, and the intermediate zone may have a smaller gas permeability than the lower zone and/or the upper zone. This has the advantage that both a uniform distribution of the air quantity is realized inside the spin shaft, and thus a uniform precooling of the filaments. On the other hand, it favors the advance of the filaments into the cooling tube. Since relatively little air enters the spin shaft in the center region of the inlet cylinder, an air stream oriented in the direction of the advancing yarn is already able to develop due to the filament speed. The air quantity supplied directly before the entry into the cooling tube thus forms an air stream that engages each filament substantially uniformly.

Since the filament speed increases as the distance from the spinneret becomes greater, and since the spacing between the individual filaments decreases at the same time, a specially advantageous embodiment of the invention provides that the gas permeability of the inlet cylinder is uniform within one zone in the direction of the advancing yarn. Thus, the air entering the spin shaft within the zone is dependent on the filament speed. This means that at a higher yarn speed, more air is supplied to the spin shaft.

The gas permeability of the wall of the inlet cylinder may differ within a zone in the direction of the advancing yarn. This makes it possible to generate over the length of the inlet cylinder a flow profile that contains no stepwise changes in the supply of the air quantity. Furthermore, it is possible to realize therewith that irrespective of the yarn speed, the air quantity entering the spin shaft can be maintained substantially unchanged over the length of the zone.

The wall of the inlet cylinder may be made from any porous material. In this connection, the wall of the inlet cylinder may be formed from a perforated sheet member having different perforations which define the plurality of zones. In this embodiment, it is possible to predetermine very precisely the gas permeability or air resistance within the wall. In this instance, the number of the inlet openings of the perforations and the diameter of the inlet openings of the perforations define the gas permeability.

An embodiment of the spinning apparatus is especially suited for generating an air stream that assists the filament movement. In this embodiment, a plurality of inlet openings forms the perforation of at least one zone. These inlet openings extend through the wall of the inlet cylinder obliquely with an inclination toward the direction of the advancing yarn, so that an air stream oriented in direction of the advancing yarn enters the inlet cylinder.

The wall of the inlet cylinder may comprise a wire cloth having different mesh sizes which define the plurality of zones. A high, substantially uniform radial air stream is thereby generated over the entire circumference of the inlet cylinder.

To be able to form the zones within the inlet cylinder, it is possible to stack individual cylinders with the same or with respectively different gas permeability. This may be realized by different mesh sizes of the wire cloth or by a different multi-layer arrangement of layers.

The changing of the gas permeability may be provided by means of a paper sleeve which is disposed in circumferential contact with the wall of the inlet cylinder. The paper sleeve thus performs an air filtering function, so that no impurities may enter the spin shaft.

To generate a uniform flow in the inlet cylinder and to prevent turbulences upon entry into the inlet cylinder, the wall in the interior of the inlet cylinder may mount in the region of at least one zone a plurality of baffles with an inclination extending from the wall in direction of the advancing yarn.

In a particularly advantageous further development of the invention, the inlet cylinder connects to the spinneret in heat transferring relationship. Thus, it is possible to heat in particular the upper zone of the inlet cylinder, which leads again to heating the air flowing through the wall, so that a shock-like cooling effect on the filaments is prevented.

In the previously described embodiments of the invention, the air stream generator may be formed by a blower in the region of the inlet cylinder, by an injector directly upstream of inlet into the cooling tube, or by a suction device that connects to the cooling tube on the outlet end thereof. The suction device has the special advantage that during spinning all emerging particles, such as for example monomers, are removed from the spin shaft. With that, a contamination of the spin shaft is prevented.

To produce a yarn of a very high, uniform quality, the arrangement of the nozzle bores within the spinneret is selected such that in the cooling tube, equidirectional and identical air streams oriented in the direction of the advancing yarn engage each individual filament.

The invention would not have been suggested either by the spinning apparatus and by the method known from DE 25 39 840. In the known method and known spinning apparatus, a uniform air stream that is used for treating the filaments is directed in the direction of, transversely, or oppositely to the direction of the advancing yarn. However, this does not apply to the spinning apparatus of the present invention. The vacuum atmosphere present in the cooling tube of the apparatus according to the invention generates an air stream in direction of the advancing yarn with a flow profile which is a function of the tube cross section and with different flow velocities.

With the present invention, the nozzle bores in the spinneret are positioned at locations based upon the prevailing flow profile of the air stream in the cooling tube and such that the air stream substantially uniformly assists the filaments in their advance through the cooling tube. Since the air stream engaging the filaments assists the filaments in their advance within the cooling tube, it is especially significant that a substantially uniform assistance in the advance be maintained for each of the filaments over the entire distance. The flow profile of the air stream that develops in the tube is dependent on the inlet geometry of the cooling tube, as well as on the inside condition of the cooling tube, and lastly on the diameter of the cooling tube and the kind of flow. In this connection, different flow velocities may develop inside the tube cross section, which would be bound to lead, in an even distribution of the filaments, to a different treatment within the tube cross section. Thus, the invention offers a possibility of arranging the filaments within the bundle of filaments in such a manner that each filament advances through the cooling tube at substantially the same flow velocity.

A funnel-shaped inlet cone may be positioned at the inlet end of the cooling tube, and the inlet bores may be annularly arranged so as to encircle an inlet zone. This has the advantage that the filament bundle safely enters the cooling tube, and that a less turbulent air stream develops in the inlet region of the cooling tube. In this connection, it has been found that the air stream inside the cooling tube exhibits a flow profile that tends to have a maximum flow velocity in the center of the cooling tube. Thus, the above configuration of the spinneret prevents the filaments from entering the cooling tube in the central region thereof.

With an oval or round tube cross section, the inlet zone of the spinneret may be encircled by one or more closed lines or circles of equally spaced apart bores. This is especially suited to advance the filaments through the cooling tube in zones of identical flow velocities. The arrangement of the nozzle bores in a closed line of bores further accomplishes that precooling is equalized inside the inlet cylinder.

The nozzle bores of adjacent lines or circles of bores are preferably offset from one another in the transverse direction. This provides a uniform precooling in the case of a plurality of lines of bores.

In a particularly advantageous further development of the spinning apparatus, the filaments advance at substantially the same distance from the wall of the inlet cylinder. This accomplishes an additional equalization of precooling and, thus, a reproducible firming up of surface layers.

To realize in the cooling tube a flow profile that is favorable for producing the yarn, it has been found that the spacing between the spinneret and the cooling tube should be from at least about 100 mm to at most about 1000 mm. In this connection, the cooling tube has a diameter in the region of the narrowest tube cross section from at least about 10 mm to at most about 40 mm.

To further delay crystallization of the filaments, and thus produce a yarn with higher elongation values, a heating device may be provided between the spinneret and the inlet cylinder for heat treating the filaments.

The same effect can also be accomplished by heating the ambient air outside on the periphery of a zone preferably the upper zone—of the inlet cylinder to a temperature from about 35° C. to about 350° C. The hot air entering the inlet cylinder thermally treats the filaments as a function of the air temperature before the actual cooling.

The apparatus of the present invention, the method of the invention, and the inventive use of a spinning apparatus are suitable to produce textile yarns or industrial yarns of polyester, polyamide, or polypropylene. It is possible to arrange downstream different treatment devices for the yarn to produce, for example, a fully drawn yarn (FDY), a partially oriented yarn (POY), or a highly oriented yarn (HOY).

BRIEF DESCRIPTION OF THE DRAWINGS

In the following, some embodiments of the spinning apparatus according to the invention are described in more detail with reference to the attached drawings, in which

FIGS. 3.1, 3.2, and 3.3 show different wall configurations with a corresponding flow profile;

FIGS. 6.1 and 6.2 show several configurations of the bores in a spinneret.

DETAILED DESCRIPTION OF THE PREFERRED EMBODIMENTS

Figure 1:
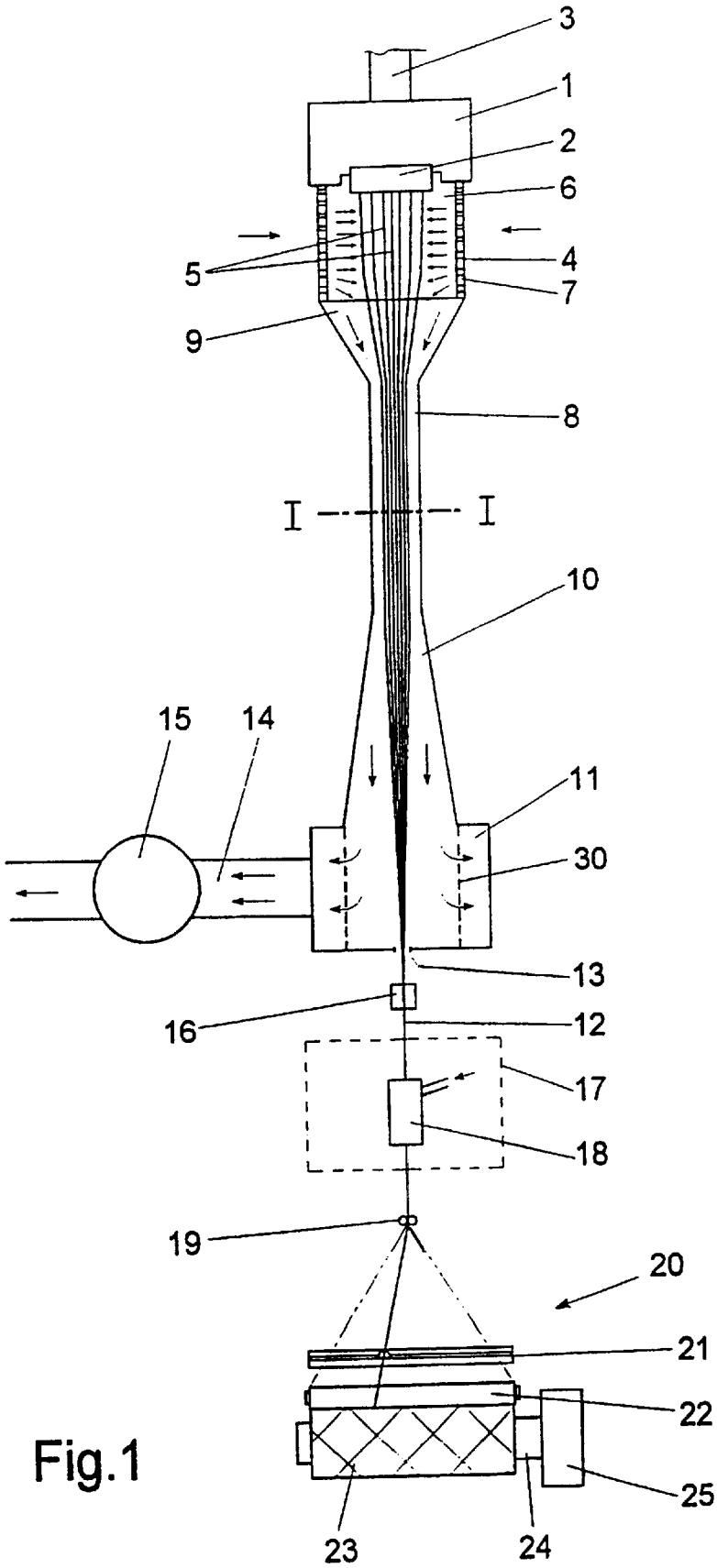
FIG. 1 shows a spinning apparatus with a take-up device downstream thereof.

FIG. 1 shows a first embodiment of a spinning apparatus of the present invention for spinning a synthetic multifilament yarn.

A yarn 12 is spun from a thermoplastic material. To this end, the thermoplastic material is melted in an extruder or a pump. A spin pump delivers the melt via a melt line 3 to a heated spin head 1. The underside of spin head 1 mounts a spinneret 2. From the spinneret 2, the melt emerges in the form of fine filament strands 5. The filaments 5 advance through a spin shaft 6 that is formed by an inlet cylinder 4. To this end, the inlet cylinder 4 extends directly downstream of the spin head 1 and encloses the filaments 5. At the free end of inlet cylinder 4, a cooling tube 8 follows in the direction of the advancing yarn. The cooling tube 8 connects to the inlet cylinder 4 via an inlet cone 9. At the opposite end of inlet cone 9, the cooling tube 8 comprises an outlet cone 10 that terminates in an outlet chamber 11. In the underside of outlet chamber 11, an outlet opening 13 is arranged in the plane of the advancing yarn. On one side of the outlet chamber 11, a suction stub 14 terminates in suction chamber 11. The suction stub 14 interconnects an air stream generator 15 arranged on the free end of suction stub 14 and the outlet chamber 11. The air stream generator 15 is constructed as a suction device. The suction device 15 may comprise, for example, a vacuum pump or a blower, which generates a vacuum in outlet chamber 11 and thus in cooling tube 8.

In the plane of the advancing yarn, a lubrication device 16 and a take-up device 20 are arranged downstream of the outlet chamber 11. The take-up device 20 comprises a yarn guide 19. The yarn guide 19 indicates the beginning of a traversing triangle that forms by the reciprocal movement of a traversing yarn guide of a traversing device 21. Downstream of the yarn traversing device 21, a contact roll 22 is arranged. The contact roll 22 lies against the circumference of a package 23 being wound. The package 23 is produced on a rotating winding spindle 24. To this end, a spindle motor 25 drives winding spindle 24. The drive of winding spindle 24 is controlled as a function of the rotational speed of the contact roll, so that the circumferential speed of the package and thus the take-up speed remain substantially constant during the winding.

Between the lubrication device 16 and the take-up device 20, a treatment device 17 is arranged for treating the yarn 12. In the embodiment of FIG. 1, the treatment device is formed by an entanglement nozzle 18.

As a function of the production process, the treatment device may comprise one or more heated or unheated godets, so that the yarn can be influenced in its tension or be drawn before its take-up. Likewise, it is possible to arrange within the treatment device 17 additional heating devices for drawing or relaxing.

In the spinning apparatus shown in FIG. 1, a polymer melt is delivered to spin head 1 and extruded via spinneret 2 to a plurality of filaments 5. The bundle of filaments is withdrawn by take-up device 20. In this process, the filament bundle advances at an increasing speed into the spin shaft 6 inside of inlet cylinder 4. Subsequently, the filament bundle enters the cooling tube 8 via inlet cone 9. In the cooling tube 8, the suction device 15 generates a vacuum, thereby sucking into cooling shaft 6 ambient air that surrounds the exterior of inlet cylinder 4. The air quantity entering spin shaft 6 is proportional to the gas permeability of wall 7 of the inlet cylinder. The inflowing air leads to a precooling of the filaments, so that the surface layers of the filaments firm up. However, in their core the filaments remain molten. The air quantity, together with the filament bundle, is then taken in, via inlet cone 9, into the cooling tube 8. Due to a narrowest cross section in cooling tube 8, the air stream is accelerated under the action of suction device 15 in such a manner that there exists no longer an air stream in the cooling tube that counteracts the movement of the filaments. With that, stress on the filaments is reduced.

To generate in the outlet region of cooling tube 8 as little turbulences as possible, the air stream flows, via outlet cone 10, into outlet chamber 11. To further stabilize the air, the outlet chamber 11 accommodates a screen cylinder 30 that surrounds the filament bundle. The air is then sucked off and removed from outlet chamber 11 via stub 14 and suction device 15. The filaments 5 exit on the underside of outlet chamber 11 through outlet opening 13 and advance into lubrication device 16. By the time the filaments emerge from the cooling tube, they are totally cooled. The lubrication device 16 combines the filaments to a yarn 12. To increase cohesion of the yarn, the yarn 12 is entangled in entanglement nozzle 18, before it is wound. In the take-up device 20, the yarn 12 is wound to package 23. In the arrangement of FIG. 1, it is possible to produce, for example, a polyester yarn that is wound at a take-up speed >7,000 m/min.

The spinning apparatus of FIG. 1 is characterized in that the air quantity entering inlet cylinder is adapted to the heat treatment of the filaments. In this connection, it is possible to influence with advantage both precooling and the suction stream. FIG. 2 shows again the inlet cylinder 4 of FIG. 1. In this embodiment, the wall 7 of inlet cylinder 4 is constructed as a perforated sheet element with two different perforations 29 and 26. In an upper zone at the end of the inlet cylinder, which faces spinneret 12, a perforation 29 with small diameters is provided. In the upper zone, the perforation leads to a schematically illustrated flow profile 28. The flow profile 28 that is symbolized by arrows provides a measurement for the air quantity entering spin shaft 6. Within the upper zone, the perforation 29 is identical. Thus, the air quantity increases as the distance from the spinneret becomes larger, due to the vacuum effect in the cooling tube 8 and due to the increasing filament speed.

In a lower zone that is formed at the end facing the cooling tube 8, the wall 7 comprises a perforation with a greater opening cross section. As shown by the symbolized flow profile 27, a larger quantity of air will enter the spin shaft 6 in the lower zone. Likewise in this instance, one can see the tendency that the inflowing air quantity increases, as the distance from the spinneret becomes greater.

Figure 2:
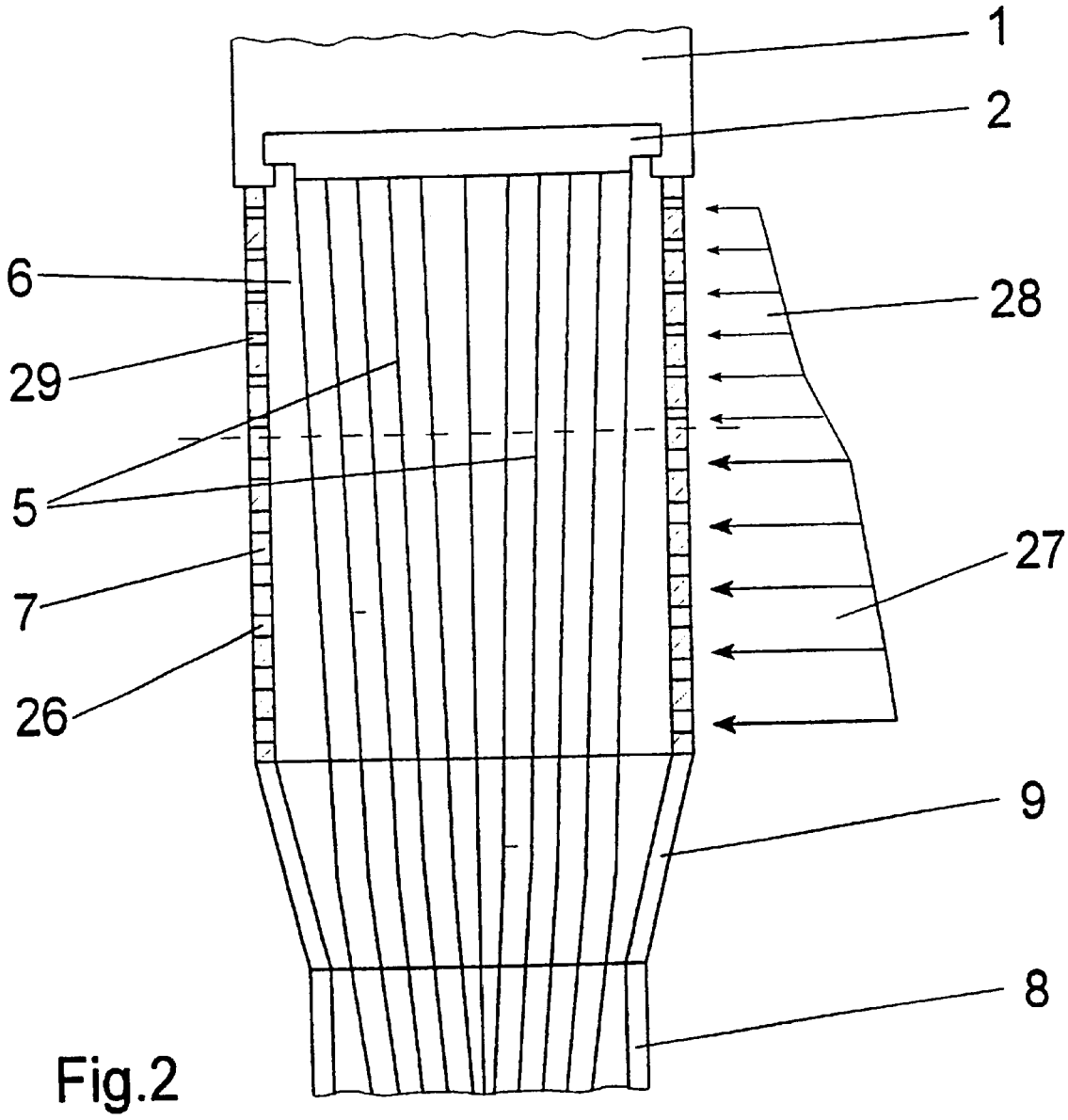
FIG. 2 shows an inlet cylinder of the spinning apparatus of FIG. 1.

The flow profile shown in FIG. 2 above the wall of the inlet cylinder is especially suitable for obtaining a slow and slight precooling of the filaments. This results in particular in a very uniform yarn cross section.

FIGS. 3.1; 3.2; and 3.3 show further embodiments of an inlet cylinder, whose wall 7 forms different flow profiles. In these embodiments, a wire cloth forms the wall 7 in the permeable zones. However, the wire cloth may advantageously be replaced with any other porous material, such as for example a sintered material.

In the embodiment of FIG. 3.1, the inlet cylinder is divided into an upper and a lower zone. The upper zone I has a greater permeability to gas than the lower zone II. The thereby developing flow profile results in that a larger quantity of air flows into the upper zone than into the lower zone II. Such an arrangement is particularly advantageous to realize a high, uniform cooling action and a uniform distribution of the air quantity within the spin shaft. In particular in the upper zone I, the filament speed is relatively low and the spacing between the filaments relatively large, so that the air quantity is able to distribute evenly in the spin shaft. As previously described with reference to FIG. 2, the air quantity increases likewise within one zone based on the unvarying gas permeability.

In the embodiment shown in FIG. 3.2, an upper zone I, an intermediate zone II, and a lower zone III are formed. In this embodiment, a relatively small quantity of air enters the spin shaft in the intermediate zone II. However, the upper zone I and the lower zone III are designed to admit a larger quantity of air. This arrangement promotes both the distribution of the air quantity within the spin shaft and the entry behavior of the filament bundle into the cooling tube. The large quantity of air in the lower zone III causes the filament bundle to contract to a greater extent when entering the cooling tube, so that the filaments are unable to strike the wall. The wall of the zones II and III is constructed such that a uniform distribution of the air quantity adjusts itself over the length of the zone. To this end, the gas permeability in the wall decreases as the distance from the spinneret increases.

FIG. 3.3 shows an embodiment, wherein an upper zone I of inlet cylinder 4 has a gas-tight wall 7. The lower zone II comprises a triangular flow profile, with the largest quantity of air entering the spin shaft 6 in the lower region. The arrangement is especially suitable for realizing a uniform formation of the filament strands in the quiet zone. Only when the melt of the filaments has slightly firmed up in the outer region, will an air stream enter the cooling shaft. This arrangement is especially suited for producing yarns with low yarn deniers.

Figure 4:
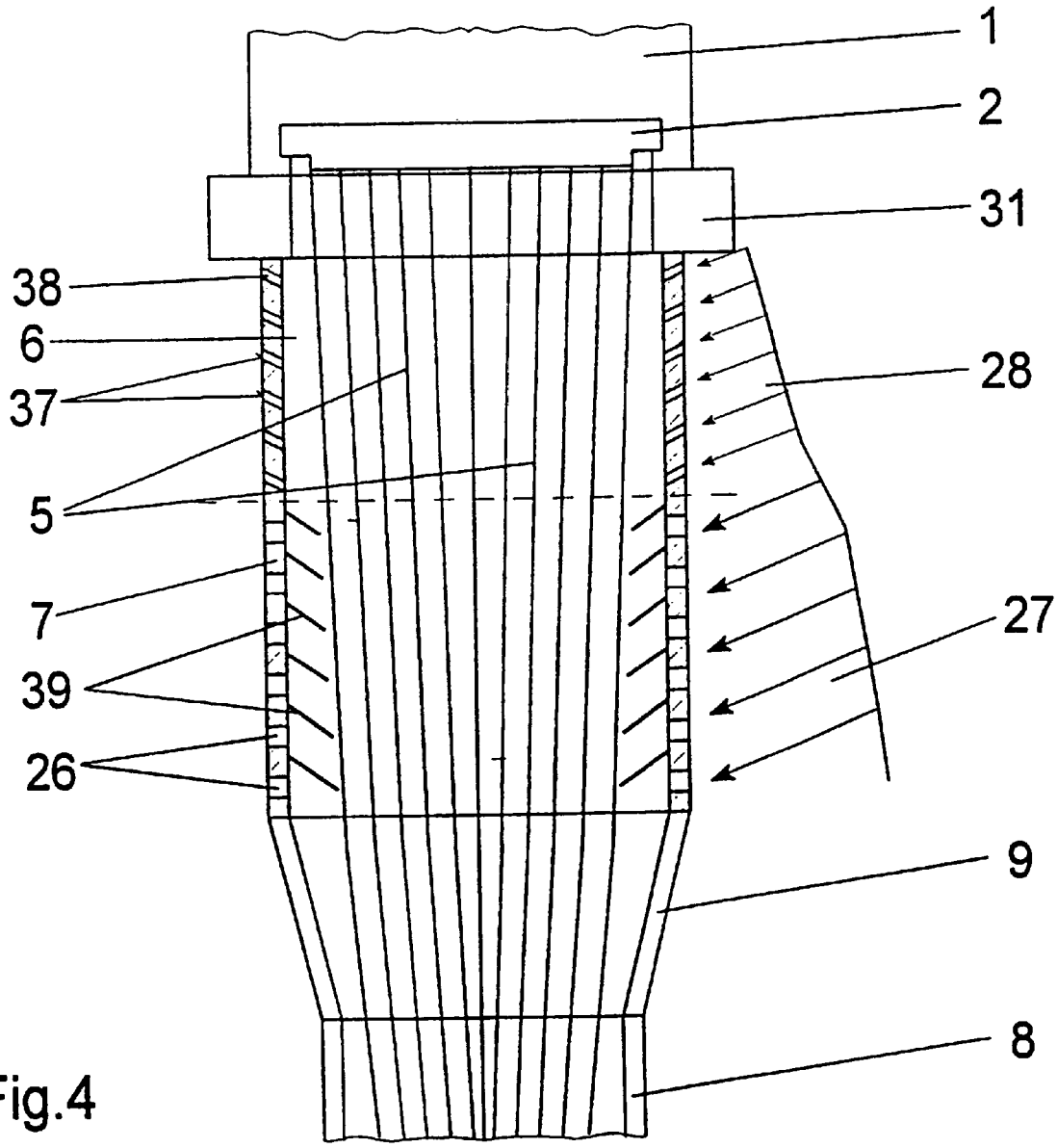
FIG. 4 shows a further embodiment of the spinning apparatus according to the invention.

In the embodiment of the spinning apparatus shown in FIG. 4, a heating device 31 is arranged between the inlet cylinder 4 and the spin head 1. The heating device 4 leads to a thermal treatment of the filaments, so that cooling is further slowed down. In this arrangement of FIG. 4, the heating device may be combined with any previously described embodiment of the inlet cylinder.

The inlet cylinder 4 comprises an upper zone with a perforation 37 and a lower zone with a perforation 26. Based on the different hole diameters of perforations 37 and 26, symbolically illustrated flow profiles 27 and 28 result. Thus, a smaller quantity of air enters the inlet cylinder 4 in the upper zone than in the lower zone thereof.

In comparison with the previously described embodiments of the spinning apparatus, the air stream entering the inlet cylinder 4 of the embodiment shown in FIG. 4 is deflected in the direction of the advancing yarn, so that the filaments are assisted with a great flow component in their movement in direction of cooling tube 8 directly upon entry of the air quantity. To this end, the inlet openings 38 of the perforation 37 in the upper zone of the inlet cylinder 4 are arranged in wall 7 obliquely with an inclination in direction of the advancing yarn. For this purpose, the length and diameter of the inlet opening 38 are selected at a predetermined ratio such that a directed flow forms upon entry into the inlet cylinder 4.

The lower zone of inlet cylinder 4 has a perforation 26 with radially directed inlet openings 38. In the interior of inlet cylinder 4, wall 7 mounts several baffles 39. The baffles 39 extend from wall 7 into the interior of inlet cylinder 4 with an inclination in the direction of the advancing yarn. Thus, the quantity of air entering through perforation 26 into the lower zone of inlet cylinder 4 is converted into a flow in direction of the advancing yarn. To optimize the flow conditions in inlet cylinder 4, the baffles 39 could be made in addition adjustable in their inclination.

Basically, it should be mentioned that the inlet cylinder might be divided into a plurality of zones to realize a uniform flow profile. In addition, by varying the combination of perforation and baffles in the inlet cylinder, it becomes further possible to influence the flow of the cooling air and the cooling of the filaments in the cooling tube.

Figure 5:
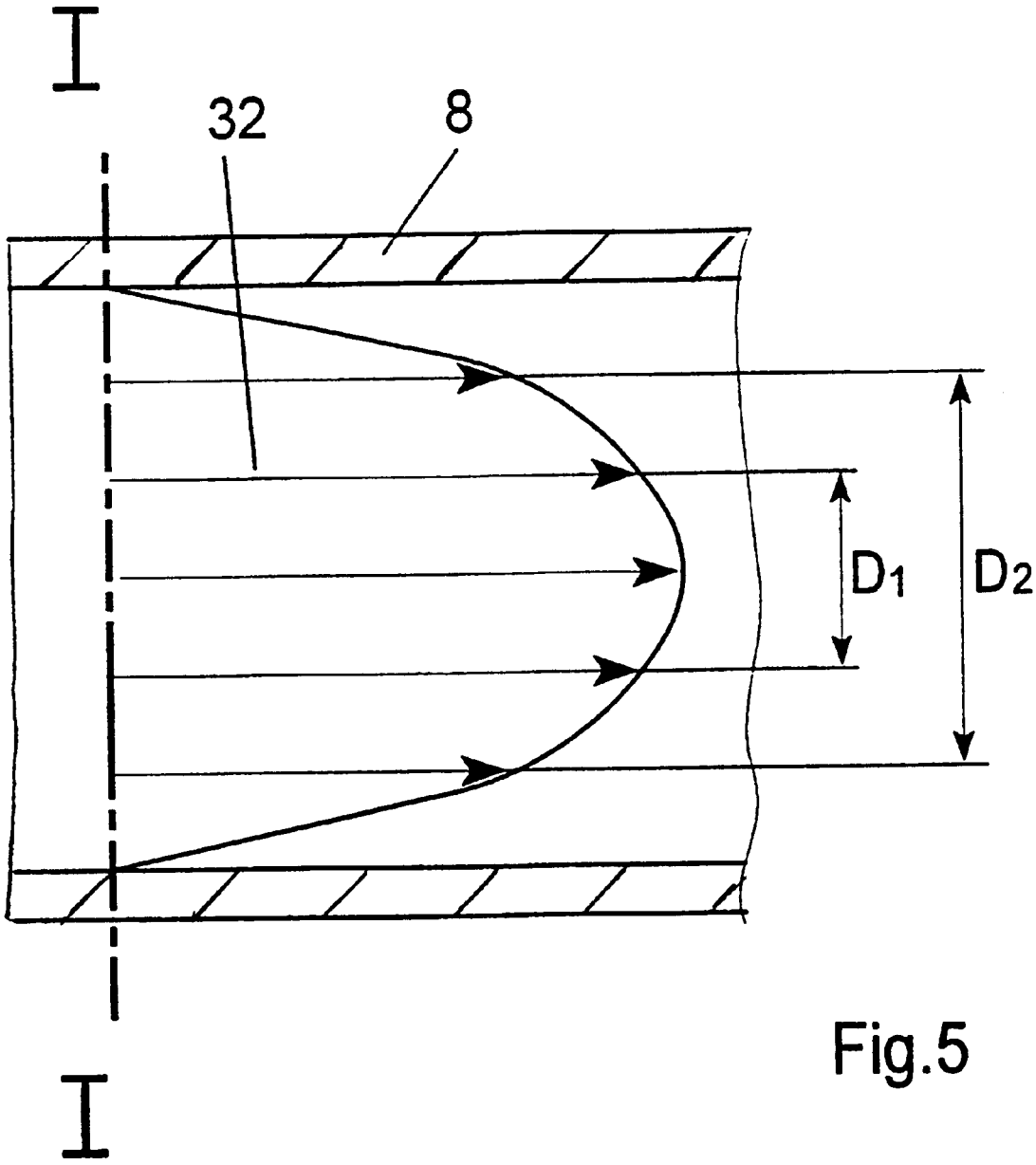
FIG. 5 shows an embodiment of a flow profile within a cooling tube of the spinning apparatus of FIG. 1.

For purposes of providing essentially the same assistance to all filaments of the filament bundle in their advance inside the cooling tube, it is necessary to surround the filaments with an air stream of substantially the same velocity. FIG. 5 shows by way of example a flow profile 32 that tends to adjust itself, for example, in the center of cooling tube 8 of the spinning apparatus of FIG. 1. The length of the arrows identifies the velocity of the air stream inside the flow profile or cooling tube. In this connection, the air stream generated by the suction device shows a maximal velocity in the center region of cooling tube 8. For this reason, the filaments advance, for example, along a pitch circle D1 or a pitch circle D2. To this end, it is necessary to arrange the nozzle bores within spinneret 2 accordingly.

FIGS. 6.1 and 6.2 show several embodiments of nozzle bore arrangements inside spinneret 2. FIG. 6.1 shows a spinneret 2, wherein nozzle bores 33 are annularly arranged in one line of bores 34. In the line of bores 34, the nozzle bores 33 are each arranged in the spinneret equally spaced from one another. The closed line of bores 34 encloses an inlet zone 35 formed in the center region of the spinneret.

FIG. 6.2 shows a further spinneret 2, wherein two lines of bores 34 and 36 are annularly arranged in the spinneret. The nozzle bores 33 of the two lines of bores 34 and 36 are offset from each other such that the nozzle bores of the inner line of bores 36 are each located between two adjacent nozzle bores of the outer line of bores 34. In their arrangements of the nozzle bores, the spinneret of FIG. 6.1 and the spinneret of FIG. 6.2 are laid out for the flow profile in the cooling tube shown in FIG. 2. The layout is based on a circular cross section of the cooling tube 8 of FIG. 1. With that, the flow profile results likewise in a circular arrangement of the nozzle bores. With the use of a cooling tube with an oval cross section or a square cross section, other flow profiles would be bound to result, which would lead to a changed arrangement of the nozzle bores inside the spinneret.

In the production of a polyester yarn with a denier of 2.4 dtex, the spinning apparatus of FIG. 1 was used. In this process, a spinneret with an areal arrangement of the nozzle bores and a spinneret of the type of FIG. 1 were used for comparison. In all, both spinnerets had 55 nozzle bores. The nozzle bores were arranged within a pitch circle of 60 mm. In its narrowest cross section, the cooling tube had a smallest diameter of 16 mm. The spacing between the spinneret and the cooling tube amounted to 260 mm. The cooling tube connected to the inlet cylinder via an inlet cone of 75 mm length. The take-up speed was 6,000 m/min. In the direct comparison, it was found that the spinneret with an areal distribution of the nozzle bores resulted in a yarn that exhibited a very high amount of lint. The yarn had a boiling shrinkage of 9.6% and an elongation of 62%. In the method of the present invention with an annular arrangement of the nozzle bores, a yarn was produced that showed no lint formation. The boiling shrinkage was 3.1% and elongation 56%. With that, the special advantage of the method and the apparatus of the present invention lies in that it is possible to produce a qualitatively superior yarn with a high spinning reliability.

The invention is not limited to a certain configuration of the inlet cylinder and the cooling tube. The round shapes shown in the embodiment are exemplary and may be easily replaced with oval shapes or, in the case of rectangular spinnerets, even with angular shapes of the inlet cylinder and cooling tube. The spinneret is correspondingly variable in its shape.

That which is claimed:

1. A melt spinning apparatus for producing a multifilament yarn, comprising an extruder for heating a polymeric melt and extruding the resulting melt through a spinneret having a plurality of nozzle bores so as to form a plurality of downwardly advancing filaments, a cooling tube mounted below the spinneret so that the downwardly advancing filaments pass therethrough, an air stream generator connected to the cooling tube for generating an air stream through the cooling tube in the direction of the advancing filaments, a gas permeable inlet cylinder positioned between the spinneret and the cooling tube and through which the filaments advance, and such that a substantially radially inflowing quantity of air passes into the inlet cylinder and forms said air stream which then passes through said cooling tube, said inlet cylinder being subdivided in the direction of the advancing yarn into a plurality of zones, with each zone having a different gas permeability so as to control the quantity of air entering the inlet cylinder and the cooling tube, and wherein the inlet cylinder comprises an upper zone adjacent the spinneret and a lower zone adjacent the cooling tube, and wherein the upper zone has a lower gas permeability than the lower zone.

2. The melt spinning apparatus as defined in claim 1 wherein the upper zone is gas impermeable.

3. The melt spinning apparatus as defined in claim 1 wherein the inlet cylinder further comprises an intermediate zone formed between the upper and lower zones, and wherein the intermediate zone has a lower gas permeability than the upper zone and/or the lower zone.

4. The melt spinning apparatus as defined in claim 1 wherein the gas permeability of the inlet cylinder is uniform within at least one of said zones in the direction of the advancing yarn.

5. The melt spinning apparatus as defined in claim 1 wherein the gas permeability of the inlet cylinder is non-uniform within at least one of said zones in the direction of the advancing yarn.

6. The melt spinning apparatus as defined in claim 1 wherein the inlet cylinder comprises a wall which is formed by a perforated sheet member having different perforations which define the plurality of zones.

7. The melt spinning apparatus as defined in claim 6 wherein the perforations of at least one zone comprise inlet openings which extend throughout said wall obliquely and so as to have a component extending in the direction of the advancing filaments.

8. The melt spinning apparatus as defined in claim 1 wherein the inlet cylinder comprises a wall which is formed by a wire cloth having different mesh sizes which define the plurality of zones.

9. The melt spinning apparatus as defined in claim 1 wherein the inlet cylinder comprises a wall which is formed by a stack of several perforated sheet members and/or wire cloths.

10. The melt spinning apparatus as defined in claim 1 wherein the inlet cylinder comprises a perforated wall and a sleeve of filtering material disposed in circumferential contact with the wall.

11. The melt spinning apparatus as defined in claim 1 wherein the inlet cylinder comprises a perforated wall and several baffles disposed within the wall of at least one of the zones, with the baffles being inclined in the direction of the advancing filaments.

12. The melt spinning apparatus as defined in claim 1 wherein the extruder includes a spin head which mounts said spinneret, and wherein the inlet cylinder is positioned in heat transferring engagement to said spin head.

13. The melt spinning apparatus as defined in claim 1 wherein said air stream generator comprises a suction device connected to said cooling tube on the exterior thereof.

14. The melt spinning apparatus as defined in claim 1 wherein said nozzle bores of said spinneret are arranged such that substantially identical air streams oriented in the direction of the advancing filaments engage respective filaments as the filaments enter the cooling tube.

15. A melt spinning apparatus for producing a multifilament yarn, comprising an extruder for heating a polymeric melt and extruding the resulting melt through a spinneret having a plurality of nozzle bores so as to form a plurality of downwardly advancing filaments, a cooling tube mounted below the spinneret so that the downwardly advancing filaments pass therethrough, an air stream generator connected to the cooling tube for generating an air stream through the cooling tube in the direction of the advancing filaments, and wherein a prevailing flow profile is developed in the cross section of the cooling tube, and wherein said nozzle bores are positioned at locations in said spinneret depending on the prevailing flow profile of the air stream in the cooling tube and such that the air stream substantially uniformly assists the filaments in their advance through the cooling tube.

16. The melt spinning apparatus as defined in claim 15 further comprising a gas permeable inlet cylinder positioned between the spinneret and the cooling tube and through which the filaments advance, and such that a substantially radially inflowing quantity of air passes into the inlet cylinder and forms said air stream which then passes through said cooling tube.

17. The melt spinning apparatus as defined in claim 16 wherein at least a portion of the length of the cooling tube has a cross section which is less than the cross section of the filaments as they emerge from the nozzle bores of the spinneret.

18. The melt spinning apparatus as defined in claim 17 wherein the cooling tube includes an inlet end of funnel shape, and wherein the nozzle bores are annularly arranged the center of which defines an inlet zone in the center of a filament bundle.

19. The melt spinning apparatus as defined in claim 18 wherein the nozzle bores are arranged in at least two concentric circles, and wherein the nozzle bores of the two circles are respectively offset from each other in a transverse direction.

20. The melt spinning apparatus as defined in claim 16 wherein said inlet cylinder defines a peripheral wall, and wherein the nozzle bores are annularly arranged in such a manner that the filaments enter the inlet cylinder at a substantially equal distance from said peripheral wall.

21. The melt spinning apparatus as defined claim 16 wherein the cooling tube is spaced below the spinneret a distance between about 100 mm and about 1000 mm, and wherein the cooling tube has a cross section over at least a portion of its length which has a diameter between about 10 mm and about 40 mm.

22. The melt spinning apparatus as defined in claim 16 further comprising a heating device for thermally treating the filaments arranged between the spinneret and the inlet cylinder.

23. The melt spinning apparatus as defined in claim 16 further comprising means for controlling the temperature of the ambient air surrounding at least a portion of the inlet cylinder to a range between about 35° C. and about 350° C.

24. A method for melt spinning a multifilament yarn comprising the steps of extruding a heated polymeric melt through a spinneret having a plurality of nozzle bores so as to form a plurality of downwardly advancing filaments, positioning a cooling tube below the spinneret so that the downwardly advancing filaments pass therethrough, generating an air stream so as to flow along with the advancing filaments through the cooling tube, determining the prevailing flow profile of the air stream in the cooling tube and positioning the nozzle bores in the spinneret at locations depending on the prevailing flow profile such that the air stream substantially uniformly assists the filaments in their advance through the cooling tube, gathering the advancing filaments to form an advancing multifilament yarn, and winding the advancing multifilament yarn into a package.

25. The method as defined in claim 24 comprising the further step of the positioning a gas permeable inlet cylinder between the spinneret and the cooling tube so that the advancing filaments pass therethrough and then enter the cooling tube, and such that a substantially radially inflowing quantity of air passes into the inlet cylinder and forms said air stream which flows through the cooling tube.

26. The method as defined in claim 24 wherein the nozzle bores in the spinneret are annularly arranged in a closed line of bores, with the bores being equally spaced apart in the closed line.

27. A melt spinning apparatus for producing a multifilament yarn, comprising an extruder for heating a polymeric melt and extruding the resulting melt through a spinneret having a plurality of nozzle bores so as to form a plurality of downwardly advancing filaments, a cooling tube mounted below the spinneret so that the downwardly advancing filaments pass therethrough, an air stream generator connected to the cooling tube for generating an air stream through the cooling tube in the direction of the advancing filaments, a gas permeable inlet cylinder positioned between the spinneret and the cooling tube and through which the filaments advance, and such that a substantially radially inflowing quantity of air passes into the inlet cylinder and forms said air stream which then passes through said cooling tube, said inlet cylinder being subdivided in the direction of the advancing yarn into a plurality of zones, with each zone having a different gas Permeability so as to control the quantity of air entering the inlet cylinder and the cooling tube, and wherein the gas permeability of the inlet cylinder is non-uniform within at least one of said zones in the direction of the advancing yarn.

28. A melt spinning apparatus for producing a multifilament yarn, comprising an extruder for heating a polymeric melt and extruding the resulting melt through a spinneret having a plurality of nozzle bores so as to form a plurality of downwardly advancing filaments, a cooling tube mounted below the spinneret so that the downwardly advancing filaments pass therethrough, an air stream generator connected to the cooling tube for generating an air stream through the cooling tube in the direction of the advancing filaments, a gas permeable inlet cylinder positioned between the spinneret and the cooling tube and through which the filaments advance, and such that a substantially radially inflowing quantity of air passes into the inlet cylinder and forms said air stream which then passes through said cooling tube, said inlet cylinder being subdivided in the direction of the advancing yarn into a plurality of zones, with each zone having a different gas Permeability so as to control the quantity of air entering the inlet cylinder and the cooling tube, and wherein the inlet cylinder comprises a wall which is formed by a perforated sheet member having different perforations which define the plurality of zones, and wherein the perforations of at least one zone comprise inlet openings which extend throughout said wall obliquely and so as to have a component extending in the direction of the advancing filaments.

29. A melt spinning apparatus for producing a multifilament yarn, comprising an extruder for heating a polymeric melt and extruding the resulting melt through a spinneret having a plurality of nozzle bores so as to form a plurality of downwardly advancing filaments, a cooling tube mounted below the spinneret so that the downwardly advancing filaments pass therethrough, an air stream generator connected to the cooling tube for generating an air stream through the cooling tube in the direction of the advancing filaments, a gas permeable inlet cylinder positioned between the spinneret and the cooling tube and through which the filaments advance, and such that a substantially radially inflowing quantity of air passes into the inlet cylinder and forms said air stream which then passes through said cooling tube, said inlet cylinder being subdivided in the direction of the advancing yarn into a plurality of zones, with each zone having a different gas permeability so as to control the quantity of air entering the inlet cylinder and the cooling tube, and wherein the inlet cylinder comprises a wall which is formed by a stack of several perforated sheet members and/or wire cloths.

30. A melt spinning apparatus for producing a multifilament yarn, comprising an extruder for heating a polymeric melt and extruding the resulting melt through a spinneret having a plurality of nozzle bores so as to form a plurality of downwardly advancing filaments, a cooling tube mounted below the spinneret so that the downwardly advancing filaments pass therethrough, an air stream generator connected to the cooling tube for generating an air stream through the cooling tube in the direction of the advancing filaments, a gas permeable inlet cylinder positioned between the spinneret and the cooling tube and through which the filaments advance, and such that a substantially radially inflowing quantity of air passes into the inlet cylinder and forms said air stream which then passes through said cooling tube, said inlet cylinder being subdivided in the direction of the advancing yarn into a plurality of zones, with each zone having a different gas permeability so as to control the quantity of air entering the inlet cylinder and the cooling tube, and wherein the inlet cylinder comprises a perforated wall and several baffles disposed within the wall of at least one of the zones, with the baffles being inclined in the direction of the advancing filaments.

* * * * *

UNITED STATES PATENT AND TRADEMARK OFFICE

CERTIFICATE OF CORRECTION

PATENT NO. : 6,572,798 B2
DATED : June 3, 2003
INVENTOR(S) : Nitschke et al.

It is certified that error appears in the above-identified patent and that said Letters Patent is hereby corrected as shown below:

Title page,
Item [56], References Cited, U.S. PATENT DOCUMENTS, "5,219,852" should read -- 5,219,582 --.

Column 13,
Lines 6-7 and 31-32, "Permeability" should read -- permeability --.

Signed and Sealed this

Twenty-third Day of September, 2003

JAMES E. ROGAN
*Director of the United States Patent and Trademark Office*